US010967635B2

(12) United States Patent
Mizuno

(10) Patent No.: US 10,967,635 B2
(45) Date of Patent: Apr. 6, 2021

(54) LIQUID DISCHARGE HEAD

(71) Applicant: BROTHER KOGYO KABUSHIKI KAISHA, Nagoya (JP)

(72) Inventor: Taisuke Mizuno, Yokkaichi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/531,290

(22) Filed: Aug. 5, 2019

(65) Prior Publication Data

US 2020/0101730 A1 Apr. 2, 2020

(30) Foreign Application Priority Data

Sep. 27, 2018 (JP) ..... JP2018-181402

(51) Int. Cl.
*B41J 2/14* (2006.01)
*B41J 29/377* (2006.01)

(52) U.S. Cl.
CPC ..... *B41J 2/1433* (2013.01); *B41J 29/377* (2013.01)

(58) Field of Classification Search
CPC .... B41J 2/1433; B41J 29/377; B41J 2202/12; B41J 2202/08; B41J 2/14072; B41J 2/14233; B41J 2002/14419; B41J 2002/14491
See application file for complete search history.

(56) References Cited

U.S. PATENT DOCUMENTS

2016/0221337 A1* 8/2016 Sugiura ..... B41J 2/14233

FOREIGN PATENT DOCUMENTS

JP 2003-53970 A 2/2003

OTHER PUBLICATIONS

IP.com search (Year: 2020).*

* cited by examiner

*Primary Examiner* — Lisa Solomon
(74) *Attorney, Agent, or Firm* — Merchant & Gould P.C.

(57) ABSTRACT

There is provided a liquid discharge head including a first channel unit and a second channel unit. The first channel unit includes: a first joining surface; a tube disposed on an opposite surface opposite to the first joining surface; an outside portion; and a coupling portion. The second channel unit is joined to the first joining surface. An end of the outside portion and an end of the coupling portion in an orthogonal direction orthogonal to the first joining surface extend to an identical position in the orthogonal direction. The tube includes a circumferential portion that is exposed outside and extends in the orthogonal direction to the identical position to which the end of the outside portion and the end of the coupling portion extend.

21 Claims, 9 Drawing Sheets

LIQUID DISCHARGE HEAD

CROSS REFERENCE TO RELATED APPLICATION

The present application claims priority from Japanese Patent Application No. 2018-181402 filed on Sep. 27, 2018, the disclosure of which is incorporated herein by reference in its entirety.

BACKGROUND

Field of the Invention

The present disclosure relates to a liquid discharge head including a first channel unit and a second channel unit that are joined to each other.

Description of the Related Art

There is known a technique in which two units included in a liquid discharge head and respectively having channels are joined to each other. For example, there is known a technique in which a channel unit (a second channel unit) including a channel formed having a nozzle and a pressure chamber is joined to a casing (a first channel unit) that is made using a resin and includes a channel for introducing ink from the outside into the channel unit. A joining surface of the casing on the opposite side of the surface to which the channel unit is joined is provided with a tube defining an ink introduction opening, a raised portion defining a gap, and a rib coupling the tube with the raised portion.

SUMMARY

In the above liquid discharge head, the rib does not protrude beyond the tube and the joining surface. This makes it difficult to press the rib when the casing (the first channel unit) is joined to the channel unit (the second channel unit). The shortage of pressing force may cause joining failure.

An object of the present disclosure is to provide a liquid discharge head that inhibits joining failure between a first channel unit and a second channel unit.

According to an aspect of the present disclosure, there is provided a liquid discharge head, including: a first channel unit in which a first channel is defined, the first channel unit including: a first joining surface; an opposite surface that is opposite to the first joining surface; a tube disposed on the opposite surface and defining the first channel; an outside portion disposed on the opposite surface and positioned outside the tube; and a coupling portion disposed on the opposite surface and coupling the outside portion and the tube, and a second channel unit in which a second channel communicating with the first channel is defined, the second channel unit including a second joining surface joined to the first joining surface of the first channel unit. An end of the outside portion and an end of the coupling portion in an orthogonal direction orthogonal to the first joining surface extend to an identical position in the orthogonal direction. The tube includes a circumferential portion that is exposed outside and extends in the orthogonal direction to the identical position to which the end of the outside portion and the end of the coupling portion extend.

DESCRIPTION OF THE EMBODIMENTS

<Printer 100>

Figure 1:
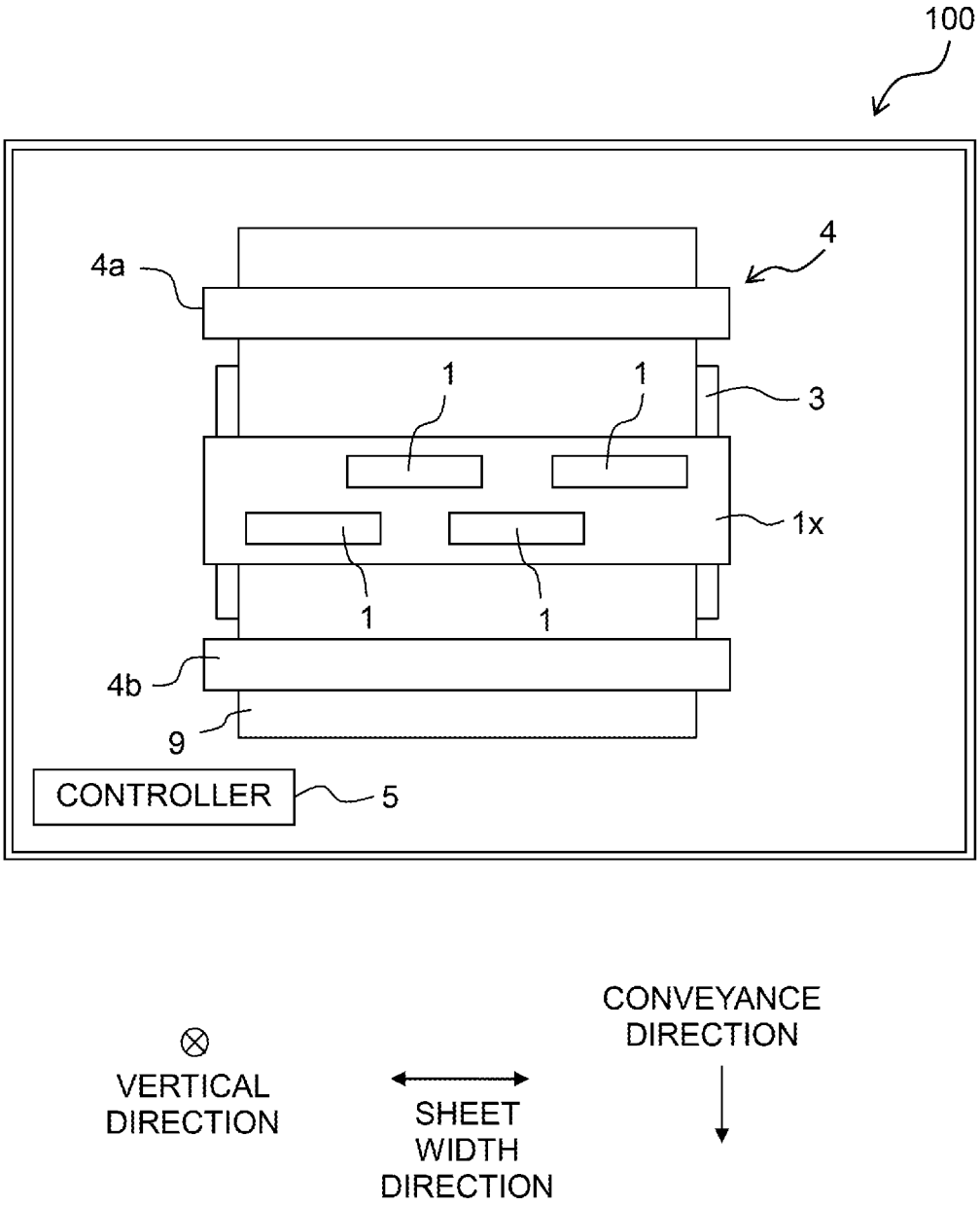
FIG. 1 is a plan view of a printer 100 including heads 1.

Referring to FIG. 1, a configuration of a printer 100 including heads 1 according to an embodiment of the present disclosure is explained. A sheet width direction, a conveyance direction, and a vertical direction in this embodiment are defined as indicated in FIG. 1.

The printer 100 includes a head unit 2 provided with four head units 1, a platen 3, a conveyer 4, and a controller 5.

The conveyer 4 has two roller pairs 4*a*, 4*b*. The two roller pairs 4*a*, 4*b* are arranged such that the platen 3 is interposed between the roller pair 4*a* and the roller pair 4*b* in the conveyance direction (a direction orthogonal to the vertical direction). When a conveyance motor (not depicted) is driven, the roller pairs 4*a*, 4*b* nipping a sheet 9 are rotated to convey the sheet 9 in the conveyance direction.

The head unit 2 is a line-type head unit in which ink is discharged from nozzles 33*d* (see FIGS. 3 and 4) on the sheet 9 with the position of the head unit 2 being secured. The head unit 2 is elongated in the sheet width direction, which is orthogonal to the vertical direction and the conveyance direction. The four heads 1 are arranged zigzag in the sheet width direction.

The platen 3, which is a flat-plate member, is disposed below the head unit 2 in a position between the two roller pairs 4*a*, 4*b* in the conveyance direction. The sheet 9 is placed on an upper surface of the platen 3.

The controller 5 includes a Read Only Memory (ROM), a Random Access Memory (RAM), and an Application Specific Integrated Circuit (ASIC). The ASIC executes a recording process and the like in accordance with programs stored in the ROM. In the recording process, the controller 5 controls the conveyance motor (not depicted) and a driver IC 60 (see FIG. 7) of each head 1 to record an image on the sheet 9 based on a recording command (including image data) input from an external apparatus, such as a PC.

<Head 1>

Figure 2:
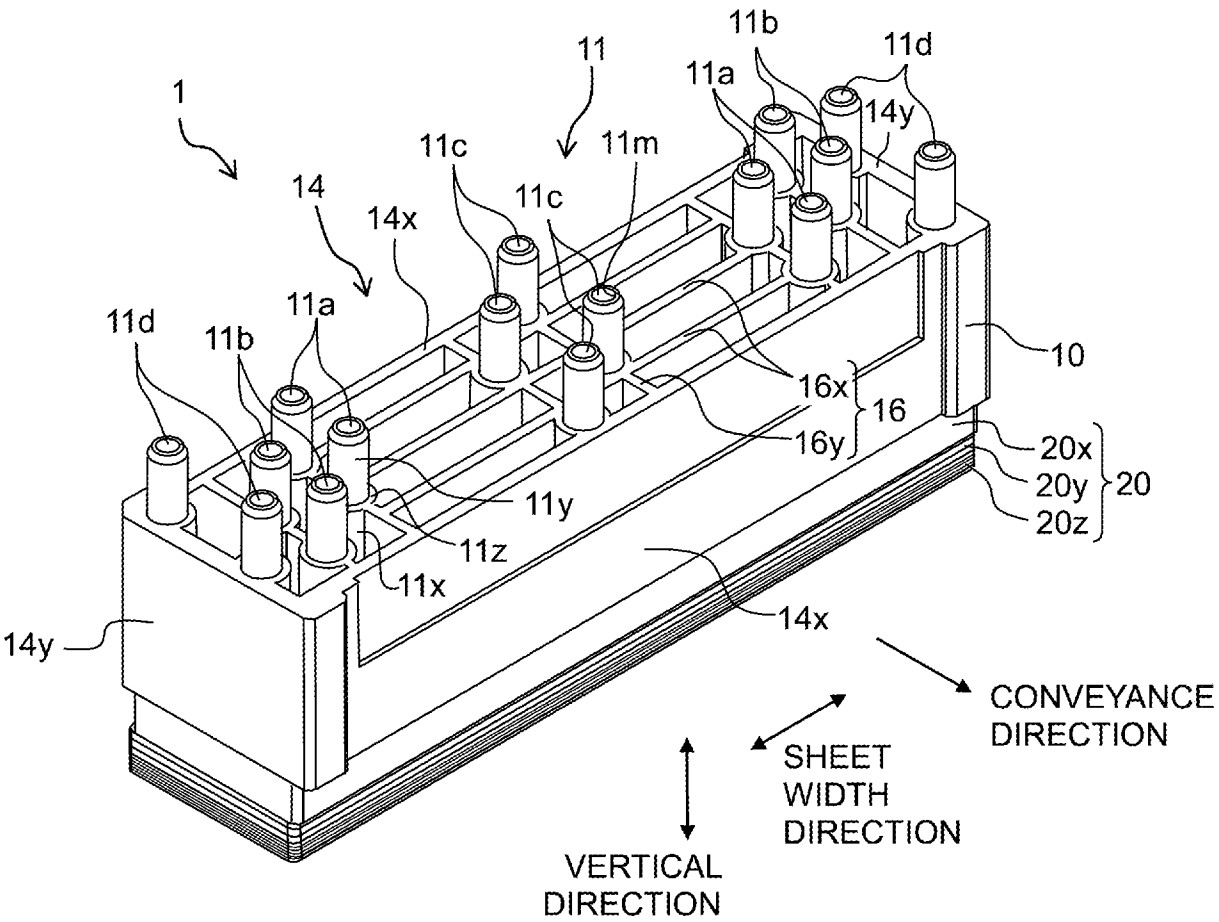
FIG. 2 is a perspective view of the head 1.

As depicted in FIG. 2, the head 1 includes a first channel unit 10 and a second channel unit 20 disposed on the lower side of the first channel unit 10. The first channel unit 10 and the second channel unit 20 are stacked on top of each other in the vertical direction. The first channel unit 10 is joined to the second channel unit 20. Each of the first channel unit 10 and the second channel unit 20 has a substantially rectangular parallelepiped shape that is long in the sheet width direction.

<Second Channel Unit 20>

The second channel unit 20 has a joint unit 20*x*, a filter unit 20*y* disposed on the lower side of the joint unit 20*x*, and a channel unit 20*z* disposed on the lower side of the filter unit 20*y*. The units 20*x*, 20*y*, and 20*z* are stacked on top of each other in the vertical direction. The units 20*x*, 20*y*, and 20*z* are joined to each other.

Figure 4:
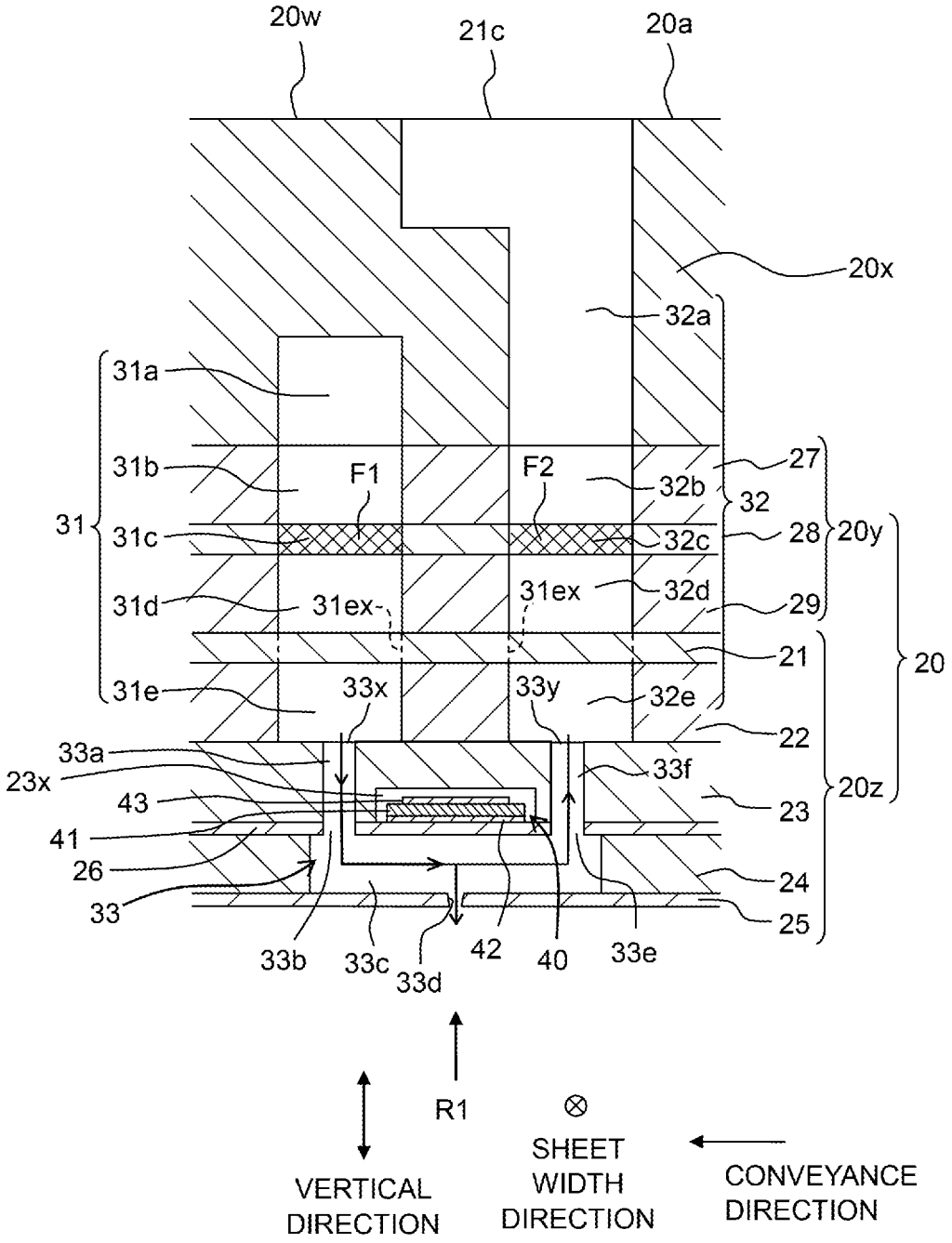
FIG. 4 is a cross-sectional view of the second channel unit 20 taken along a line IV-IV in FIG. 3.

As depicted in FIG. 4, the channel unit 20*z* includes five plates 21 to 25. The five plates 21 to 25 are stacked on top of each other in the vertical direction. The five plates 21 to 25 are joined to each other.

Of the five plates 21 to 25, the lowermost plate 25 has through holes forming the respective nozzles 33*d*.

Figure 3:
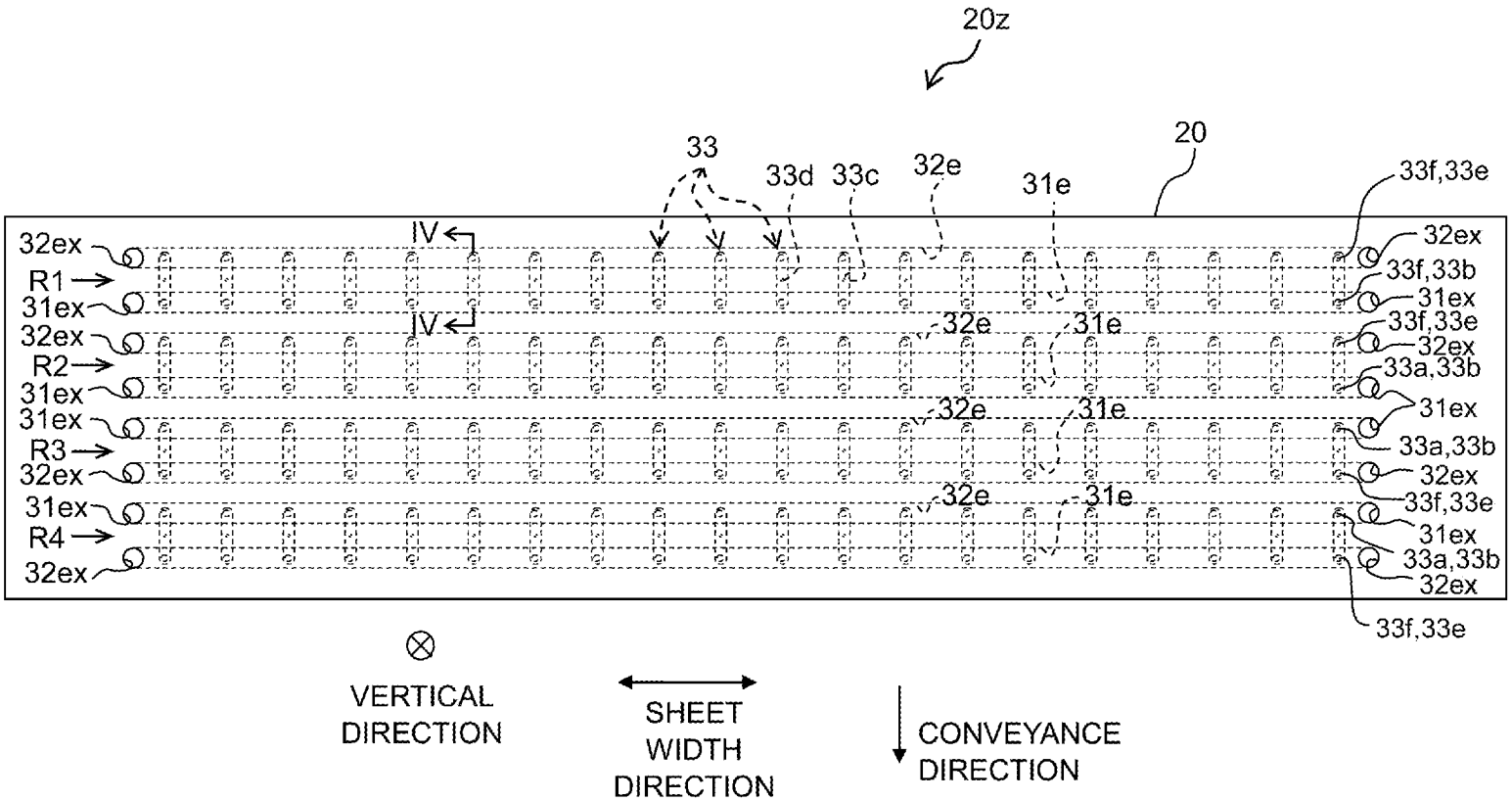
FIG. 3 is a plan view of a channel unit 20*z* included in a second channel unit 20 of the head 1.

The plate 24 is disposed on an upper surface of the plate 25. The plate 24 has through holes forming respective pressure chambers 33*c*. Each of the pressure chambers 33*c* corresponds to one of the nozzles 33*d*. As depicted in FIG. 3, the nozzle 33*d* overlaps in the vertical direction with a center portion of the pressure chamber 33*c* in the sheet width direction and the conveyance direction.

Four rows R1 to R4 are arranged side by side in the conveyance direction. Each of the four rows R1 to R4 is extended in the sheet width direction, and includes a plurality of pairs of the nozzle and the pressure chamber. Each of the pairs of the nozzle and the pressure chamber includes one nozzle 33*d* and one pressure chamber 33*c*. A black ink is discharged from the nozzles 33*d* belonging to the first row R1 from an upstream side in the conveyance direction. A yellow ink is discharged from the nozzles 33*d* belonging to the second row R2 from the upstream side in the conveyance direction. A cyan ink is discharged from the nozzles 33*d* belonging to the third row R3 from the upstream side in the conveyance direction. A magenta ink is discharged from the nozzles 33*d* belonging to the fourth row R4 from the upstream side in the conveyance direction.

As depicted in FIG. 4, a vibration film 26 is disposed on an upper surface of the plate 24. The vibration film 26 covers the pressure chambers 33*c*. The vibration film 26 has through holes forming inflow channels 33*b* at portions overlapping in the vertical direction with downstream ends in the conveyance direction of the pressure chambers 33*c* belonging to the rows R1 and R2 (see FIG. 3) and at portions overlapping in the vertical direction with upstream ends in the conveyance direction of the pressure chambers 33*c* belonging to the rows R3 and R4 (see FIG. 3). Further, the vibration film 26 has through holes forming outflow channels 33*e* at portions overlapping in the vertical direction with upstream ends in the conveyance direction of the pressure chambers 33*c* belonging to the rows R1 and R2 (see FIG. 3) and at portions overlapping in the vertical direction with downstream ends in the conveyance direction of the pressure chambers 33*c* belonging to the rows R3 and R4 (see FIG. 3). The vibration film 26 is made using, for example, silicon dioxide ($SiO_2$). In that case, the vibration film 26 can be formed by oxidizing the upper surface of the plate 24.

The plate 23 is disposed on an upper surface of the vibration film 26. As depicted in FIGS. 3 and 4, the plate 23 has through holes forming inflow channels 33*a* at portions overlapping in the vertical direction with the respective inflow channels 33*b* and through holes forming outflow channels 33*f* at portions overlapping in the vertical direction with the respective outflow channels 33*e*. As depicted in FIG. 4, a lower surface of the plate 23 includes four recesses 23*x* that accommodate respective actuators 40. Each of the actuators 40 is disposed in a space formed by the vibration film 26 and the recess 23*x*.

The actuators 40 correspond to the respective four rows R1 to R4. Each actuator 40 includes a common electrode 42 disposed on the upper surface of the vibration film 26, a piezoelectric body 41 disposed on an upper surface of the common electrode 42, and individual electrodes 43 disposed on an upper surface of the piezoelectric body 41. The piezoelectric body 41 and the common electrode 42 extend in the sheet width direction over the pressure chambers 33*c* belonging to each of the rows R1 to R4. The individual electrodes 43 are provided corresponding to the pressure chambers 33*c* to overlap in the vertical direction the respective pressure chambers 33*c*.

The common electrode 42 and the individual electrodes 43 are connected to a Chip On Film (COF) 50. The common electrode 42 and the individual electrodes 43 are electrically connected to the driver IC 60 (see FIG. 7) via the COF 50. The controller 5 controls the driver IC 60 to keep the potential of the common electrode 42 the ground potential and to change the potential of each individual electrode 43. Specifically, the driver IC 60 generates a driving signal based on a control signal from the controller 5 and supplies the driving signal to the individual electrode 43. This changes the potential of the individual electrode 43 between a predefined driving electrode and the ground potential. The change in potential of the individual electrode 43 deforms a portion that is included in the vibration film 26 and the piezoelectric body 41 and is interposed between the individual electrode 43 and the pressure chamber 33*c* so that the portion becomes convex toward the pressure chamber 33*c*. This changes the volume of the pressure chamber 33*c* to apply pressure to ink in the pressure chamber 33*c*, thus discharging ink from the nozzle 33*d*.

The individual channels 33 are formed in the plates 23 to 25 and the vibration film 26. Each of the individual channels 33 includes the inflow channel 33*a*, the inflow channel 33*b*, the pressure chamber 33*c*, the nozzle 33*d*, the outflow channel 33*e*, and the outflow channel 33*f*.

The plate 22 is disposed on an upper surface of the plate 23. The plate 22 includes four supply common channels 31*e* and four return common channels 32*e*. As depicted in FIG. 3, a set or group of one supply common channel 31*e* and one return common channel 32*e* is provided for each of the four rows R1 to R4. The arrangement of the common channels 31*e* and 32*e* in the rows R1 and R2 is opposite to that in the rows R3 and 4. The return common channel 32*e* is disposed at the upstream side in the conveyance direction and the supply common channel 31*e* is disposed at the downstream side in the conveyance direction in each of the rows R1 and R2, and the supply common channel 31*e* is disposed at the upstream side in the conveyance direction and the return common channel 32*e* is disposed at the downstream side in the conveyance direction in each of the rows R3 and R4. The supply common channels 31*e* extend in the sheet width direction to overlap in the vertical direction with the inflow channels 33*a* that communicate with the pressure chambers 33*c* belonging to the rows R1 to R4. The return common channels 32*e* extend in the sheet width direction to overlap in the vertical direction with the outflow channels 33*f* that communicate with the pressure chambers 33*c* belonging to the rows R1 to R4.

As depicted in FIG. 4, the plate 21 is disposed on an upper surface of the plate 22. As depicted in FIG. 3, the plate 21 has supply holes 31*ex* at portions overlapping in the vertical direction with ends in the sheet width direction of each supply common channel 31*e* and return holes 32*ex* at portions overlapping in the vertical direction with ends in the sheet width direction of each return common channel 32*e*.

As depicted in FIG. 4, the filter unit 20*y* includes three plates 27 to 29. The plate 29 is disposed on an upper surface of the plate 21. The plate 28 is disposed on an upper surface of the plate 29. The plate 27 is disposed on an upper surface of the plate 28. The three plates 27 to 29 are stacked on top of each other in the vertical direction. The three plates 27 to 29 are joined to each other.

The joint unit 20*x* is a member having a rectangular parallelepiped shape and made using a resin (e.g., liquid crystal polymer resin and epoxy resin). The joint unit 20*x* is disposed on an upper surface of the plate 27.

The filter unit 20*y* and the joint unit 20*x* are formed having channels 31*a* to 31*d* communicating with the supply common channels 31*e* via the supply holes 31*ex* (see FIG. 3) and channels 32*a* to 32*d* communicating with the return common channels 32*e* via the return holes 32*ex* (see FIG. 3). The channels 31*a* to 31*e* form a supply channel 31 and the channels 32*a* to 32*e* form a return channel 32. In the plate 28, through holes forming the channels 31*c* and 32*c* are provided with respective filters F1 and F2.

Figure 5:
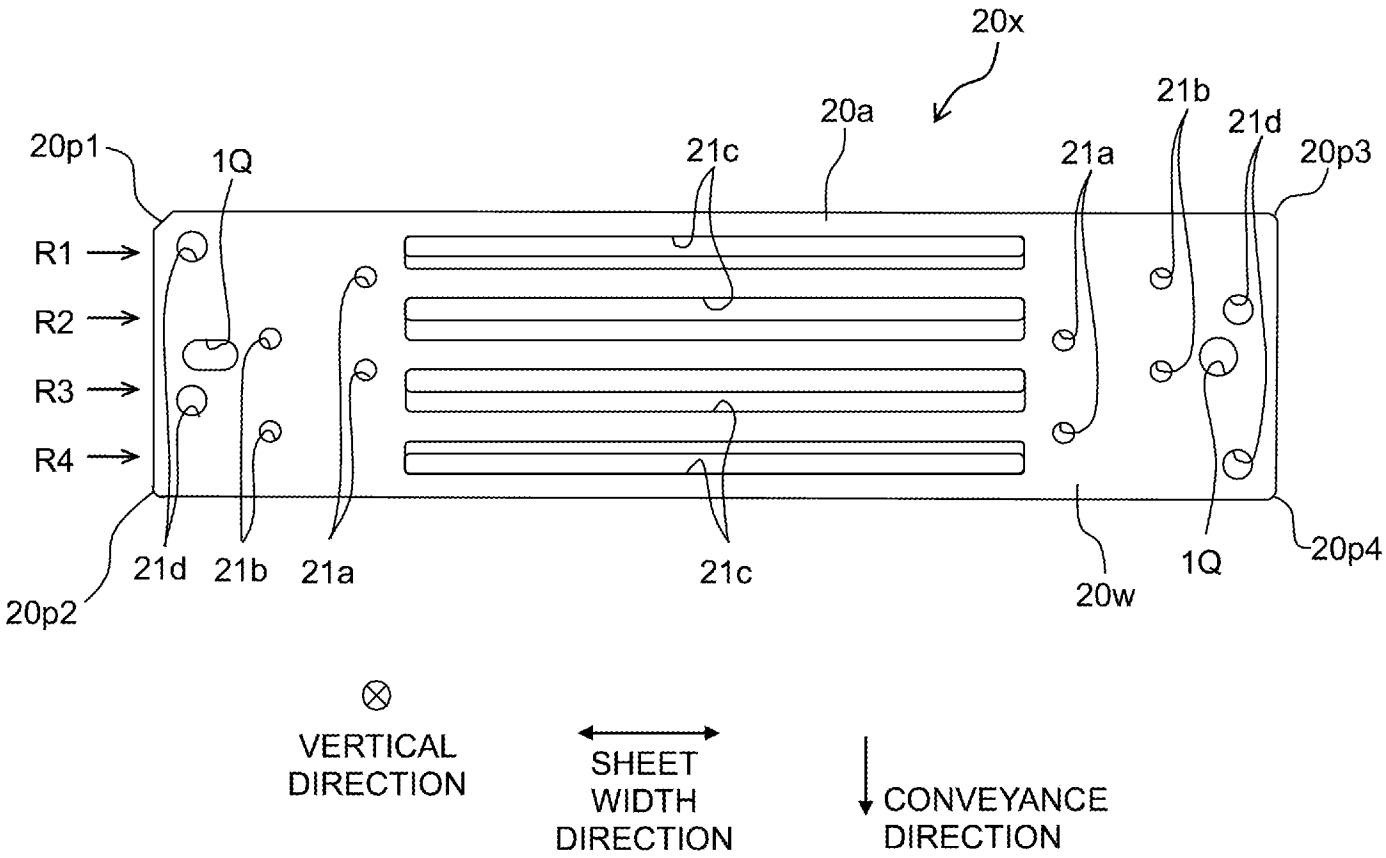
FIG. 5 is a plan view of a joint unit 20*x* included in the second channel unit 20 of the head 1.

As depicted in FIG. 5, an upper surface of the joint unit 20*x* (an upper surface 20*a* of the second channel unit 20) has four circular openings 21*a*, four circular openings 21*b*, and four circular openings 21*d*, four openings 21*c* extending in the sheet width direction and arranged in the conveyance direction, and a wall 20*w* defining those openings. Two of the four openings 21*a*, two of the four openings 21*b*, and two of the four openings 21*d* are disposed at one end in the sheet width direction of the upper surface 20*a*, and the remaining two openings 21*a*, the remaining two openings 21*b*, and the remaining openings 21*d* are disposed at the other end. The four openings 21*c* are provided at a center portion in the sheet width direction of the upper surface 20*a*. A set or group of one opening 21*a*, one opening 21*b*, one opening 21*c*, and one opening 21*d* is provided for each of the four rows R1 to R4.

The opening 21*a* and opening 21*b* communicate with the channel 31*a* (see FIG. 4). The joint unit 20*x* includes a channel extending from the channel 31*b* to the opening 21*a* via the channel 31*a* and a channel extending from the channel 31*b* to the opening 21*b*. The channel extending from the channel 31*b* to the opening 21*a* via the channel 31*a* forms the supply channel 31. The channel extending from the channel 31*b* to the opening 21*b* forms a supply branch channel branching off from the supply channel 31.

The opening 21*c* and opening 21*d* communicate with the channel 32*d* (see FIG. 4). The opening 21*c* is provided at an upper end of the channel 32*a*. The joint unit 20*x* includes a channel branching off from the channel 32*d* and extending to the opening 21*d* without passing through the filter F2. The channel forms a return branch channel branching off from the return channel 32.

As depicted in FIG. 5, the upper surface 20*a* has positioning holes 1Q at ends in the sheet width direction.

<First Channel Unit 10>

Figure 6:
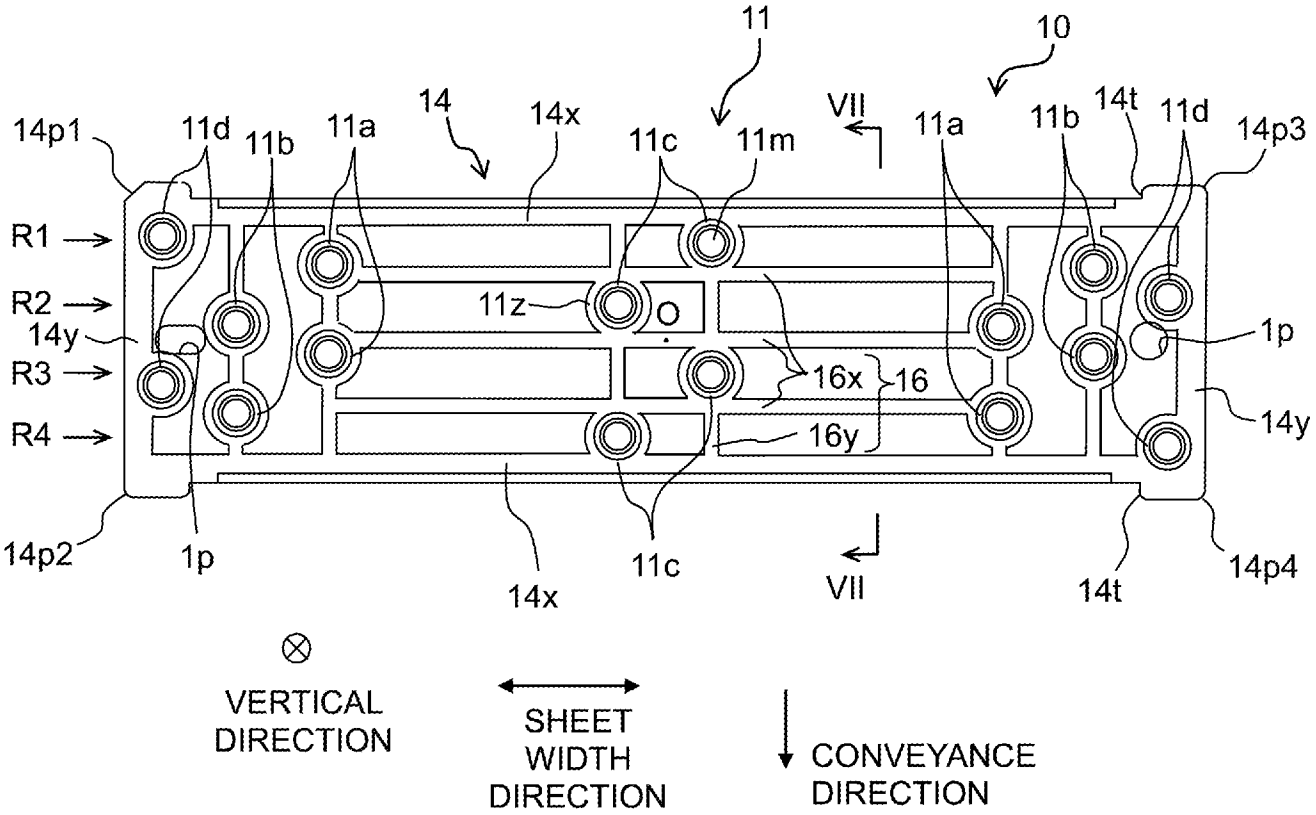
FIG. 6 is a plan view of a first channel unit 10 of the head 1.

The first channel unit 10 is integrally molded by using a resin (e.g., liquid crystal polymer resin and epoxy resin). As depicted in FIG. 6, the first channel unit 10 has positioning holes 1P at the ends in the sheet width direction. The positioning holes 1P are formed at positions overlapping in the vertical direction with the positioning holes 1Q (see FIG. 5). The positioning holes 1P pass through the first channel unit 10 in the vertical direction.

Figure 7:
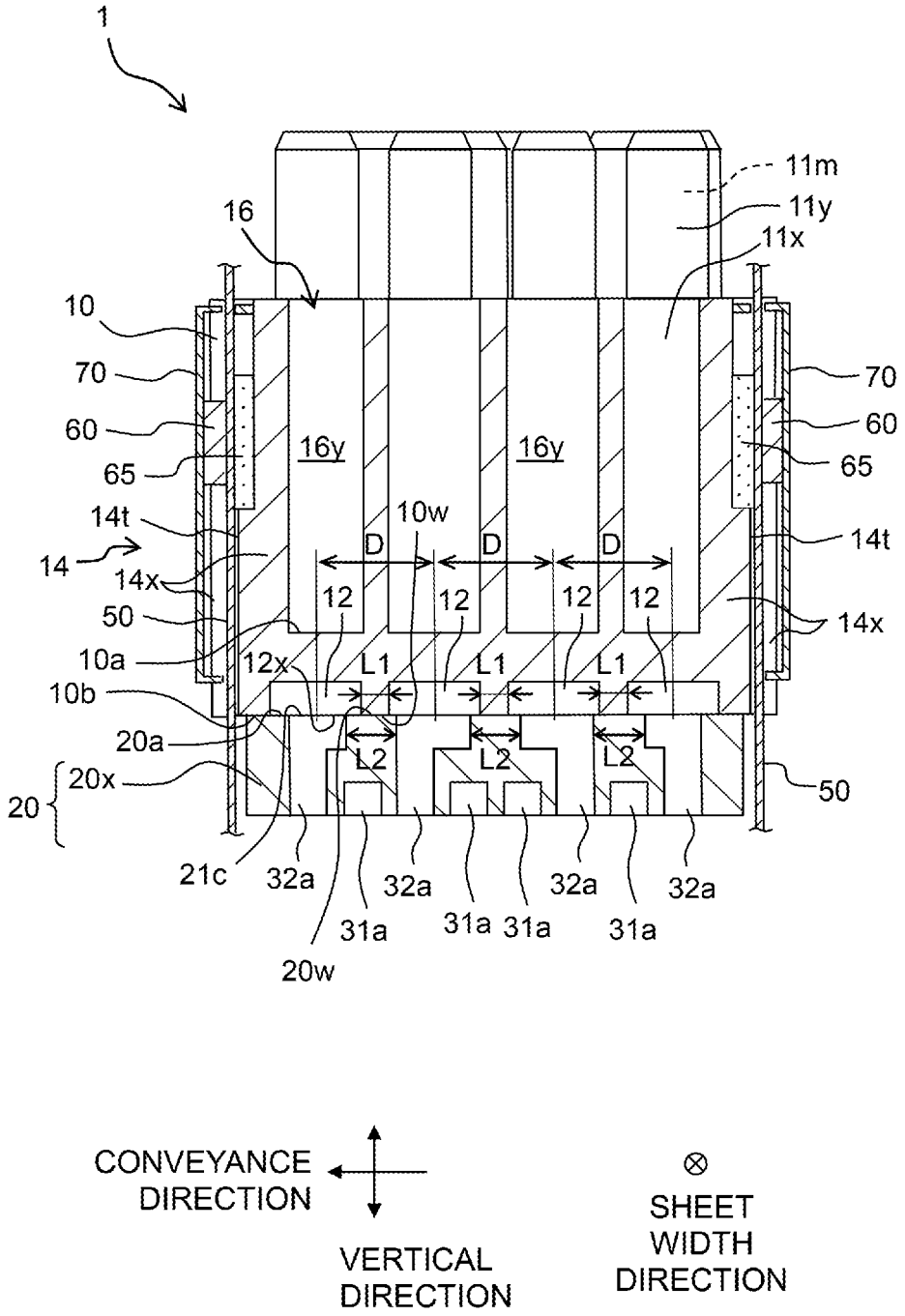
FIG. 7 is a cross-sectional view of the first channel unit 10 and the joint unit 20*x* taken along a line VII-VII in FIG. 6.

As depicted in FIG. 7, the first channel unit 10 has a lower surface 10*b* joined to the upper surface 20*a* of the second channel unit 20 and an upper surface 10*a* disposed on the opposite side of the lower surface 10*b*.

As depicted in FIGS. 2, 6, and 7, the upper surface 10*a* includes tubes 11, an outside portion 14 having a rectangular frame shape and positioned outside the upper surface 10*a* with respect to the tubes 11, and a coupling portion 16 coupling the outside portion 14 and the tubes 11. Each tube 11 has a substantially columnar shape extending in the vertical direction. The outside portion 14 includes a pair of walls 14*x* extending in the sheet width direction and the vertical direction and a pair of walls 14*y* extending in the conveyance direction and the vertical direction. The coupling portion 16 includes three walls 16*x* extending in the sheet width direction and the vertical direction and six walls 16*y* extending in the conveyance direction and the vertical direction. The length (height) in the vertical direction of the walls 14*x*, 16*x* is longer than the length (thickness) in the conveyance direction of the walls 14*x*, 16*x*. The length (height) in the vertical direction of the walls 14*y*, 16*y* is longer than the length (thickness) in the sheet width direction of the walls 14*y*, 16*y*. For example, the length (height) in the vertical direction of the walls 14*x*, 14*y*, 16*x*, and 16*y* may be approximately 10 mm, the length (thickness) in the conveyance direction of the walls 14*x*, 16*x* and the length (thickness) in the sheet width direction of the walls 14*y*, 16*y* may be approximately 0.8 mm.

Upper ends in the vertical direction of the outside portion 14 and the coupling portion 16 have the same height. Each tube 11 includes a base 11*x*, a protrusion 11*y*, and a circumferential portion 11*z*. The base 11*x* of the tube 11 is disposed in the same range in the vertical direction as the outside portion 14 and the coupling portion 16 (in other words, overlapping in the sheet width direction or the conveyance direction with the outside portion 14 and the coupling portion 16). The protrusion 11*y* of the tube 11 is positioned above the base 11*x*. The circumferential portion 11*z* of the tube 11 is a boundary between the base 11*x* and the protrusion 11*y* and has the same height in the vertical direction as the upper ends of the outside portion 14 and the coupling portion 16. The circumferential portion 11*z* and the upper ends of the outside portion 14 and the coupling portion 16 are exposed to the outside.

Each tube 11 defines a channel 11*m* passing through the first channel unit 10 in the vertical direction. The tubes 11 include four tubes 11*a* overlapping in the vertical direction with the four openings 21*a* (see FIG. 5), four tubes 11*b* overlapping in the vertical direction with the four openings 21*b* (see FIG. 5), four tubes 11*c* overlapping in the vertical direction with center portions in the sheet width direction of the four openings 21*c* (see FIG. 5), and four tubes 11*d* overlapping in the vertical direction with the four openings 21*d* (see FIG. 5). As depicted in FIG. 6, a set or group of one tube 11*a*, one tube 11*b*, one tube 11*c*, and one tube 11*d* is provided for each of the four rows R1 to R4. A total of 16 tubes 11 are arranged symmetrically with respect to a center point O of the first channel unit 10 in a plane orthogonal to the vertical direction. The six tubes 11 and the coupling portion 16 are arranged at each end in the sheet width direction of the first channel unit 10. The four tubes 11*c* and the coupling portion 16 are arranged at a center portion in the sheet width direction of the first channel unit 10.

Figure 8:
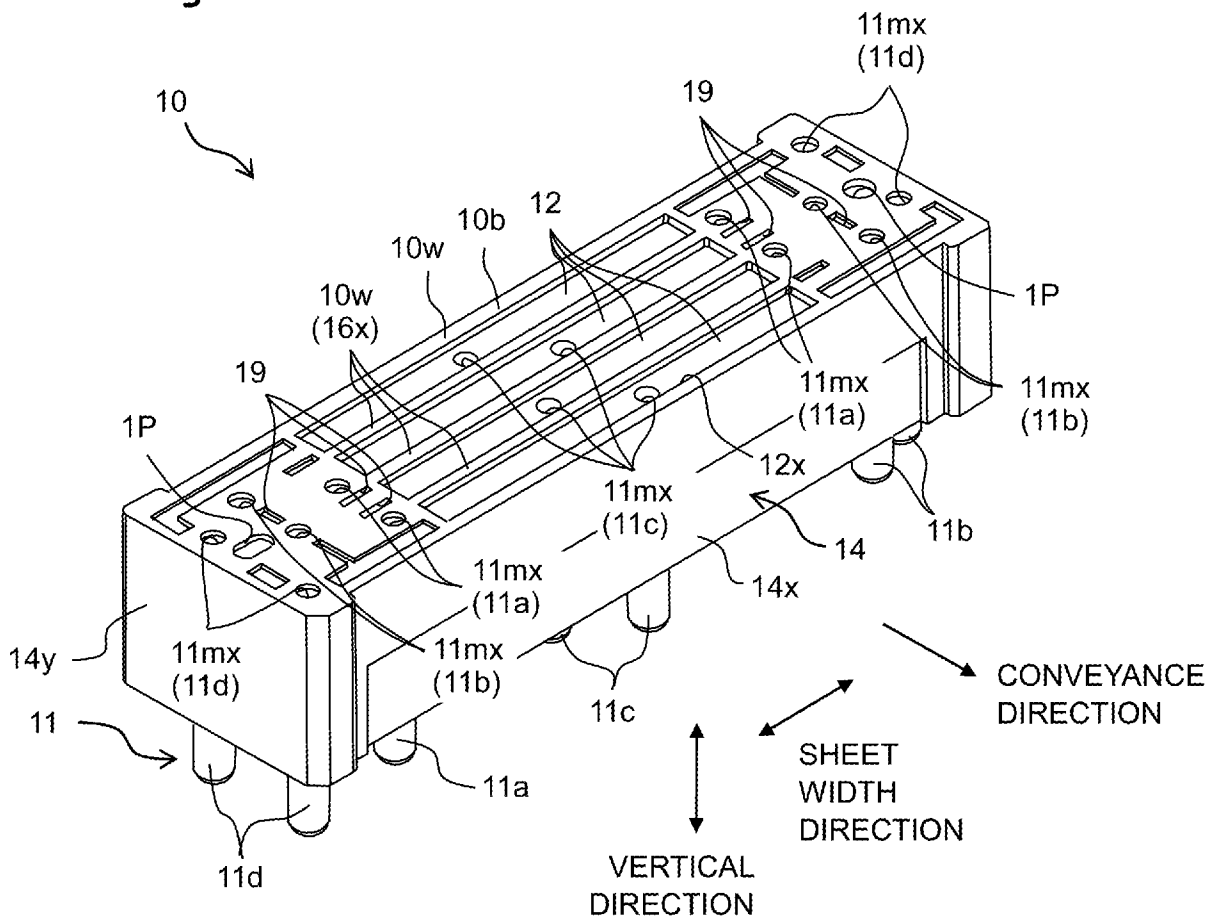
FIG. 8 is a perspective view of a lower surface 10*b* of the first channel unit 10.

As depicted in FIGS. 7 and 8, the lower surface 10*b* has openings 11*mx* of the channels 11*m* of the tubes 11, openings 12*x* of four channels 12 overlapping in the vertical direction with the four openings 21*c*, the positioning holes 1P, and a wall 10*w* defining the openings. The openings 12*x* of the four channels 12 extend in the sheet width direction and are arranged in the conveyance direction. As depicted in FIG. 8, the openings 11*mx* of the channels 11*m* of the four tubes 11*c* are provided at bottom surfaces of the four openings 12*x*.

As depicted in FIG. 7, the four channels 12 communicate with the four channels 32*a* via the openings 12*x* and openings 21*c*. Of the four channels 12, the first and fourth channels 12 from the upstream side in the conveyance direction are defined by lower ends of the walls 14*x* of the outside portion 14 and lower ends of the walls 16*x* of the coupling portion 16, and the second and third channels 12 from the upstream side in the conveyance direction are defined by lower ends of the walls 16*x* of the coupling portion 16. The walls 14*x*, 16*x* do not overlap in the vertical direction with the openings 21*c* and overlap in the vertical direction with portions included in the wall 20*w* and extending in the sheet width direction to define the openings 21*c*.

Portions (lower ends of the three walls 16*x*) included in the wall 10*w* and positioned between the channels 12 in the conveyance direction each have a length L1 in the conveyance direction. Portions included in the wall 20*w* and positioned between the channels 32*a* in the conveyance direction each have a length L2 in the conveyance direction. In order to overlap the wall 10*w* with the wall 20*w* in the vertical direction even when the positional displacement of the first channel unit 10 to the second channel unit 20 in the conveyance direction is caused during the joining, the length L2 is longer than the length L1. The length L2 can be longer than the length L1 by not less than 0.5 mm. For example, the length L2 may be 1.5 mm and the length L1 may be 0.8 mm. A center-to-center distance D in the conveyance direction between the four openings 12*x* is the same as a center-to-center distance D in the conveyance direction between the four openings 21*c*.

As depicted in FIG. 8, areas of the wall 10*w* on both sides in the sheet width direction with the four openings 12*x* interposed therebetween overlap in the vertical direction with the wall 20*w* (see FIG. 5). In the above areas, the openings 11*mx* of the tubes 11*a*, 11*b*, and 11*d* overlap in the vertical direction with the openings 21*a*, 21*b*, and 21*d*.

The above areas of the wall 10*w* have recesses 19 between the openings 11*mx*. Each recess 19 is separated from each opening 11*mx* by not less than 0.5 mm. The recess(es) 19 is/are formed between the openings 11*mx*. Further, the recess(es) 19 is/are formed at the outside of the openings 11*mx*.

As depicted in FIG. 6, the outside portion 14 has four corners 14*p*1 to 14*p*4 protruding outward. The corner 14*p*1 is different in shape from the remaining corners 14*p*2 to 14*p*4. Specifically, the corner 14*p*1 includes a notch or cutout larger than those of the corners 14*p*2 to 14*p*4. Similar to this configuration, as depicted in FIG. 5, the joint unit 20*x* includes four corners 20*p*1 to 20*p*4 protruding outward. The corner 20*p*1 is different in shape from the remaining corners 20*p*2 to 20*p*4. Specifically, the corner 20*p*1 includes a notch or cutout larger than those of the corners 20*p*2 to 20*p*4. The corners 14*p*1 and 20*p*1 have the same shape when seen in the vertical direction.

As depicted in FIGS. 6 and 7, outside surfaces of the walls 14*x* of the outside portion 14 have hollows 14*t* for guiding the COF 50. The COF 50 has a first end connected to the actuators 40 (see FIG. 4) and a second end connected to a control board (not depicted) disposed above the first channel unit 10. A portion, of the COF 50, between the first end and the second end is pulled out toward the outside of the second channel unit 20 in the sheet width direction and extending upward and toward the outside of the first channel unit 10. As depicted in FIG. 7, the driver IC 60 is placed on an outer surface of the COF 50. A heatsink 70 is installed in the outside portion 14 to cover the driver IC 60. The heatsink 70, which is made using a material enabling heat release, is brought into contact with and thermally connected to the driver IC 60. The material enabling heat release is a material having high thermal conductivity. For example, it is possible to use a metal material such as aluminum. An urging member 65 such as a sponge is disposed at a portion of an inner surface of the COF 50 (a surface opposite to the surface on which the driver IC 60 is placed) overlapping in the sheet width direction with the driver IC 60. The urging force of the urging member 65 directed from the inside toward the outside results in a reliable contact between the driver IC 60 and the heatsink 70.

<Circulation of Ink>

Each tube 11 communicates with a subtank (not depicted) corresponding thereto via a tube attached to the protrusion 11*y*. The subtanks correspond to the respective rows R1 to R4 and contain inks of the respective colors. The four tubes 11 belonging to the row R1 communicate with the subtank containing the black ink, the four tubes 11 belonging to the row R2 communicate with the subtank containing the yellow ink, the four tubes 11 belonging to the row R3 communicate with the subtank containing the cyan ink, and the four tubes 11 belonging to the row R4 communicate with the subtank containing the magenta ink.

Four main tanks (not depicted) respectively containing the black ink, yellow ink, cyan ink, and magenta ink are installed in the printer 100. The subtank provided for the row R1 communicates with the main tank for the black ink and contains the black ink supplied from the corresponding main tank. The subtank provided for the row R2 communicates with the main tank for the yellow ink and contains the yellow ink supplied from the corresponding main tank. The subtank provided for the row R3 communicates with the main tank for the cyan ink and contains the cyan ink supplied from the corresponding main tank. The subtank provided for the row R4 communicates with the main tank for the magenta ink and contains the magenta ink supplied from the corresponding main tank.

For example, in the recording process, the controller 5 circulates ink along a circulation route starting from and returning to the subtank via the supply channel 31, each individual channel 33, and the return channel 32. Ink in the subtank passes through the channel 11*m* in the tube 11*a* and is supplied to the supply channel 31 (see FIG. 4) through the opening 21*a* (see FIG. 5). The ink passes through the channels 31*a* to 31*d*, flows into the supply common channel 31*e* through the supply holes 31*ex* (see FIG. 3), and then flows into each individual channel 33. As indicated by arrows in FIG. 4, in each individual channel 33, ink inflowing from an inlet 33*x* (an upper end of the inflow channel 33*a*) flows into the pressure chamber 33*c* through the inflow channels 33*a* and 33*b*. Part of the ink in the pressure chamber 33*c* is discharged from the nozzle 33*d*, and the remaining ink in the pressure chamber 33*c* passes through the outflow channels 33*e* and 33*f* and then outflows through an outlet 33*y* (an upper end of the outflow channel 33*f*). Ink outflowing through each individual channel 33 passes through the return common channel 32*e* and flows into the channels 32*d*, 32*c*, 32*b*, and 32*a* (see FIG. 4) through the return holes 32*ex* (see FIG. 3). The ink flowing into the channels 32*d*, 32*c*, 32*b*, and 32*a* outflows through the opening 21*c* (see FIG. 5), passes through the channel 11*m* in the tube 11*c*, and then returns to the subtank. Circulating ink as described above allows bubbles in each individual channel 33 to be discharged and inhibits the increase in viscosity of ink. When ink contains a settling component (a component that may settle, such as pigment), the component is agitated or stirred to inhibit the settling.

In order to remove bubbles accumulating in a lower portion of the filter F2 at the time of the maintenance of the head 1, the controller 5 circulates ink along a route including the return branch channel. If necessary, the controller 5 circulates ink along a route including the supply branch channel to remove bubbles accumulating in an upper portion of the filter F1. When ink circulates along the route including the return branch channel, ink in the subtank passes through the channel 11*m* in the tube 11*a* and is supplied to the supply channel 31 (see FIG. 4) through the opening 21*a* (see FIG. 5). Ink supplied to the supply channel 31 flows into the supply common channel 31*e* through the supply holes 31*ex* (see FIG. 3), passes through each individual channel 33 and the return common channel 32*e* in that order, and flows into the channel 32*d* (see FIG. 4) through the return holes 32*ex*. Ink flowing into the channel 32*d* passes through the channel 32*d* along the lower surface of the filter F2, passes through the return branch channel to outflow through the opening 21*d* (see FIG. 5), passes through the channel 11*m* in the tube 11*d*, and returns to the subtank. When ink circulates along the route including the supply branch channel, ink in the subtank passes through the channel 11*m* in the tube 11*a* and is supplied to the channels 31*a* and 31*b* of the supply channel 31 (see FIG. 4) positioned above the filter F1 through the opening 21*a* (see FIG. 5). Ink supplied to the channels 31*a* and 31*b* passes through the channel 31*b* along an upper surface of the filter F1, passes through the supply branch channel to outflow through the opening 21*b* (see FIG. 5), passes through the channel 11*m* in the tube 11*b*, and returns to the subtank.

In this embodiment, the head 1 corresponds to a liquid discharge head of the present disclosure, the channels 11*m* and channels 12 correspond to a first channel of the present disclosure, and the channels 31 to 33 correspond to a second channel of the present disclosure. The lower surface 10*b* corresponds to a first joining surface of the present disclosure, the upper surface 10*a* corresponds to an opposite surface of the present disclosure, the upper surface 20*a* corresponds to a second joining surface of the present disclosure, the openings 12*x* correspond to a first opening of the present disclosure, the openings 21*c* correspond to a second opening of the present disclosure, the wall 10*w* corresponds to a first wall of the present disclosure, and the wall 20*w* corresponds to a second wall of the present disclosure. The walls 14*x* correspond to a first extending portion, a second extending portion, and a third extending portion of the present disclosure, the walls 14*y* correspond to the second extending portion and a fourth extending portion of the present disclosure, the walls 16*x* correspond to the first extending portion, the second extending portion, and the third extending portion of the present disclosure, and the walls 16*y* correspond to the second extending portion and the fourth extending portion of the present disclosure. The COF 50 corresponds to a trace member of the present disclosure, the driver IC 60 corresponds to a driver of the present disclosure, and the heatsink 70 corresponds to a heatsink of the present disclosure. The vertical direction corresponds to an orthogonal direction of the present disclosure, the sheet width direction corresponds to a first direction and a fifth direction of the present disclosure, the conveyance direction corresponds to a second direction, a sixth direction, and a seventh direction of the present disclosure, and one of the sheet width direction and the conveyance direction corresponds to a third direction of the present disclosure, and the other corresponds to a fourth direction of the present disclosure.

Effects of Embodiment

In the first channel unit 10 of this embodiment, the upper ends in the vertical direction of the outside portion 14 and the coupling portion 16 have the same height. The tubes 11 have the circumferential portions 11*z* that are exposed to the outside and have the same height in the vertical direction as the upper ends of the outside portion 14 and the coupling portion 16 (see FIG. 2). In that configuration, it is possible to apply pressing force to the circumferential portions 11*z* of the tubes 11, the outside portion 14, and the coupling portion 16 when the first channel unit 10 is joined to the second channel unit 20. This inhibits the joining failure between the first channel unit 10 and the second channel unit 20.

The outside portion 14 and the coupling portion 16 overlap in the vertical direction with the wall 20*w* (see FIGS. 5 to 7). In that configuration, pressing force applied to the outside portion 14 and the coupling portion 16 is directly transmitted to the wall 20*w*, thus improving the joining strength.

The openings 21*c* extend in the sheet width direction (see FIG. 5). The outside portion 14 includes the walls 14*x* extending in the sheet width direction, and the coupling portion 16 includes the walls 16*x* extending in the sheet width direction (see FIG. 6). The walls 14*x* and walls 16*x* do not overlap in the vertical direction with the openings 21*c* (see FIG. 7). In a case that the pressing force is applied to the openings 21*c*, a width (the length in the conveyance direction) of the openings 21*c* can be narrow. In this embodiment, however, pressing force is not likely to be applied to the openings 21*c*, thus inhibiting the openings 21*c* from narrowing.

The openings 12*x* and openings 21*c* extend in the sheet width direction. The length L2 in the conveyance direction of the portion included in the wall 20*w* and positioned between the openings 21*c* in the conveyance direction is longer than the length L1 in the conveyance direction of the portion (the lower end of each of the three walls 16*x*) included in the wall 10*w* and positioned between the openings 12*x* in the conveyance direction (see FIG. 7). When the first channel unit 10 is joined to the second channel unit 20 by applying pressing force to the circumferential portions 11*z* of the tubes 11, the outside portion 14, and the coupling portion 16, it is only required that the length L1 be a length capable of transmitting pressing force from the wall 10*w* to the wall 20*w*. The length L1 is thus not required to be too long. If the length L2 is too short, each channel 32*a* would not be formed appropriately, which easily causes ink leakage. In the configuration of this embodiment, however, the length L2 is longer than the length L1. This inhibits the length L2 from being too short, inhibiting ink leakage.

The center-to-center distance D in the conveyance direction between the four openings 12*x* is the same as the center-to-center distance D in the conveyance direction between the four openings 21*c* (see FIG. 7). This allows the openings 12*x* to reliably overlap in the vertical direction with the openings 21*c*, thus allowing the channels 12 to reliably communicate with the channels 32*a*.

The length (height) in the vertical direction of the walls 14*x* and walls 16*x* is longer than the length (thickness) in the conveyance direction thereof. The length (height) in the vertical direction of the walls 14*y* and walls 16*y* is longer than the length (thickness) in the sheet width direction thereof (see FIG. 2). Making the height of walls larger than the thickness thereof inhibits a warp of walls which may otherwise be caused when pressurization or heating is performed on the first channel unit 10 and the second channel unit 20 to be joined to each other. Specifically, the walls 14*x* and walls 16*x* are not likely to be deformed in the conveyance direction and the walls 14*y* and walls 16*y* are not likely to be deformed in the sheet width direction. This inhibits a warp as well as the joining failure between the units 10 and 20.

The outside portion 14 and the coupling portion 16 respectively have the walls 14*x* and the walls 16*x* extending in the sheet width direction, which is a longitudinal direction of the first channel unit 10 (see FIG. 6). In that case, the walls 14*x* and walls 16*x* are easily formed by flowing a resin in the sheet width direction in the injection molding of the first channel unit 10. The first channel unit 10 is long in the sheet width direction. Thus, if the warp in the sheet width direction of the walls 14*x* and walls 16*x* is large, the first channel unit 10 would warp entirely and greatly. When the walls 14*x* and the walls 16*x* are formed by flowing the resin in the sheet width direction, the walls 14*x* and the walls 16*x* are likely to warp in the conveyance direction, but are not likely to warp in the sheet width direction. This inhibits the first channel unit 10 from warping entirely and greatly.

The portions (the lower ends of the three walls 16*x*) included in the wall 10*w* and positioned between the openings 12*x* in the conveyance direction each have the length L1 in the conveyance direction (see FIG. 7). In that case, variation in the flow rate of resin at the three portions, which is caused when the resin flows in the sheet width direction to form the three portions, is lower than a case the three portions have mutually different lengths L1 in the conveyance direction. This inhibits a weld line at each portion.

The three portions define the channels 12 (see FIG. 7). If the weld lines are formed at the portions defining the channels, the channels would not be formed appropriately. This may cause ink leakage, and the like. The configuration of this embodiment inhibits such a problem.

The outside portion 14 and the coupling portion 16 include not only the walls 14*x* and the walls 16*x* extending in the sheet width direction that is the longitudinal direction of the first channel unit 10 but also the walls 14*y* and the walls 16*y* extending in the conveyance direction that is a lateral direction of the first channel unit 10. In that case, providing the walls extending in the directions intersecting with each other improves the entire rigidity of the first channel unit 10. Further, flowing the resin not only in the sheet width direction but also in the conveyance direction improves the fluidity of resin, which inhibits a void and sink mark. The void is a phenomenon in which air bubbles are caused inside a molded product, and the sink mark is a phenomenon in which a surface of the molded product is concave through contraction.

The wall 10*w* has the recesses 19 (see FIG. 8). In that case, since the resin density of the wall 10*w* is reduced, which inhibits the void and sink mark and improves the flatness of the lower surface 10*b*. Further, excessive adhesive used for joining the units 10 and 20 can flow into the recesses 19. This reliably inhibits the joining failure between the first channel unit 10 and the second channel unit 20.

The recess(es) 19 is/are provided between the openings 11*mx* (see FIG. 8). In that configuration, the recess(es) 19 is/are positioned in the vicinity of the openings 11*mx*. Thus, the effect of enhancing the flatness provided by the recesses 19 reliably leads to the joining strength in the vicinity of the openings 11*mx*.

The recesses 19 are separated from the openings 11*mx* by not less than 0.5 mm. If the recesses 19 are too close to the openings 11*mx*, a joining area (joining margin) around each opening 11*mx* would be insufficient to join the units. This may cause the joining failure. In this embodiment, the recesses 19 are separated from the openings 11*mx*, thus inhibiting such a problem.

The tubes 11 and the coupling portion 16 are arranged at each end in the sheet width direction of the first channel unit 10 (the longitudinal direction of the first channel unit 10, see FIG. 6). When the unit is long in a certain direction, the joining failure is likely to be caused especially at the ends in the longitudinal direction of the unit. In the configuration of this embodiment, the tubes 11 and the coupling portion 16 are arranged at the ends in the sheet width direction, which is the longitudinal direction of the first channel unit 10. The pressing force can thus be applied to the ends in the sheet width direction, which reliably inhibits the joining failure.

The tubes 11 and the coupling portion 16 are arranged (see FIG. 6) at the center portion in the sheet width direction of the first channel unit 10 (the longitudinal direction of the first channel unit 10). When the unit is long in a certain direction, the joining failure is likely to be caused especially at the ends in the longitudinal direction of the unit. Further, since the unit easily curves in the longitudinal direction, the joining failure is likely to be caused also at the center portion in the longitudinal direction of the unit. In the configuration of this embodiment, the tubes 11 and the coupling portion 16 are arranged at the center portion in the sheet width direction, which is the longitudinal direction of the first channel unit 10. The pressing force can thus be applied to the center portion, which reliably inhibits the joining failure.

A total of 16 tubes 11 are arranged symmetrically with respect to the center point O of the first channel unit 10 in the plane orthogonal to the vertical direction (see FIG. 6). In that configuration, pressing force can be applied symmetrically to the center point O via the tubes 11, thus uniformly joining the first channel unit 10 to the second channel unit 20.

Each individual channel 33 includes the inlet 33*x* communicating with the supply channel 31 and the outlet 33*y* communicating with the return channel 32 (see FIG. 4). In that configuration, ink circulates through each individual channel 33 ranging from the inlet 33*x* to the outlet 33*y* (a route including, for example, the pressure chamber 33*c* positioned immediately above the nozzle 33*d*). That configuration, however, requires many channels. Thus, if the head 1 is small, the joining area would be insufficient to join the units. This may easily cause the joining failure. In this embodiment, in order to solve the above problem, pressure force is applied to the circumferential portions 11*z* of the tubes 11, the outside portion 14, and the coupling portion 16 to effectively inhibit the joining failure.

The outside portion 14 is provided with the driver IC 60 and the heatsink 70 (see FIG. 7). In the configuration, the driver IC 60 and the heatsink 70 are arranged by utilizing the outside portion 14 extending in the vertical direction.

The outside surfaces of the walls 14*x* of the outside portion 14 have the hollows 14*t* for guiding the COF 50 (see FIGS. 6 and 7). In the configuration of this embodiment, the COF 50 can be held appropriately by being guided by the hollows 14*t*.

Of the four corners 14*p*1 to 14*p*4 of the outside portion 14, the corner 14*p*1 is different in shape from the remaining corners 14*p*2 to 14*p*4 (see FIG. 6). In that configuration, the first channel unit 10 can be disposed at a correct position in joining of the units, thus inhibiting the deterioration in yield which may otherwise be caused when the first channel unit 10 is disposed at an incorrect position.

The positioning holes 1P and positioning holes 1Q overlapping with each other in the vertical direction are formed at the ends in the sheet width direction of the first channel unit 10 and the second channel unit 20 (the longitudinal direction of the units 10 and 20, see FIGS. 5 and 6). In that configuration, the long units 10 and 20 can be appropriately positioned relative to each other and then joined to each other.

Modified Embodiment

The embodiment of the present disclosure is explained above. The present disclosure, however, is not limited to the above. Various changes or modifications in the design may be made without departing from the claims.

In the present disclosure, the wording "the same" includes a case having a slight difference provided that the effect of the present disclosure is obtained.

In the above embodiment, the first channel unit and the second channel unit are made using a resin. However, the units may be made using any other appropriate material (e.g., a metal material) than the resin. Or, the material of the first channel unit may be different from that of the second channel unit.

The tube may not include the protrusion. Namely, the end in the orthogonal direction of the tube, the end in the orthogonal direction of the outside portion, and the end in the orthogonal direction of the coupling portion may have the same height. The tubes may not be arranged symmetrically with respect to the center point of the first channel unit. The number of tubes is not especially limited, and only one tube may be provided.

In the above embodiment, the outside portion has a circular shape. The present disclosure, however, is not limited thereto. For example, part of an outer circumferential portion of the first channel unit may not be provided with the outside portion so that part of the tube is disposed at the outermost position.

In the above embodiment, the coupling portion may extend, for example, in a direction parallel to the lower surface 10*b* and intersecting with the sheet width direction and the conveyance direction.

In the above embodiment (see FIG. 7), the length L2 may be identical to or shorter than the length L1. The center-to-center distance D between the openings 12*x* may not be the same as the center-to-center distance D between the openings 21*c*. The present disclosure is not limited to the configuration in which the center-to-center distance D between the openings 12*x* is constant and the configuration in which the center-to-center distance D between the openings 21*c* is constant. Three or more openings 12*x* may be provided at different spaced intervals in the conveyance direction, and three or more openings 21*c* may be provided at different spaced intervals in the conveyance direction.

The first wall (e.g., the wall 10*w* of the above embodiment, see FIG. 8) may have no recesses (e.g., the recesses 19 of the above embodiment, see FIG. 8) between multiple first openings. The recess(es) may be provided only outside the first openings. The first wall may have no recesses.

Figure 9C:
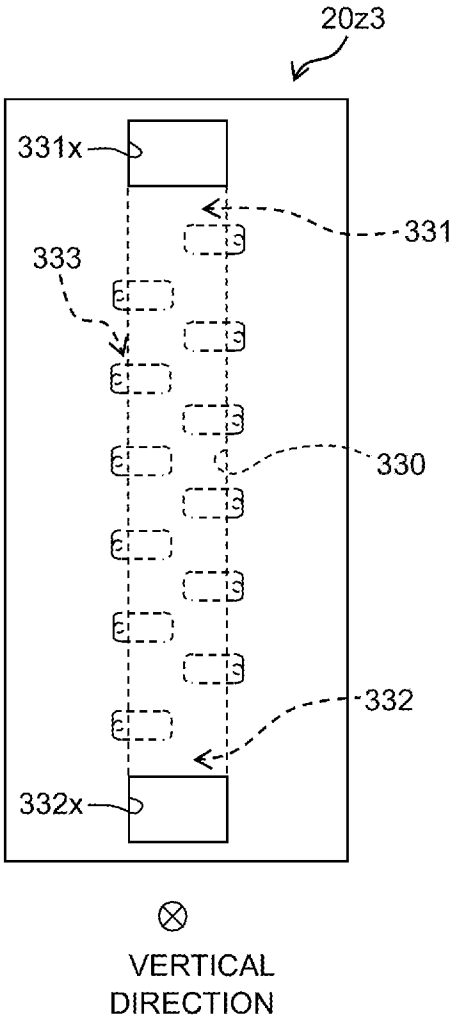
FIG. 9C is a plan view of a channel unit 20*z*3.

Instead of providing multiple supply common channels and multiple return common channels, only one supply common channel and only one return common channel may be provided. For example, a channel unit 20*z*1 according to a first modified embodiment depicted in FIG. 9A includes a supply common channel 131*e* and a return common channel 132*e*.

The positions of the supply holes and the return holes and the number of the supply holes and the return holes are not limited to those of the above embodiment. For example, in the first modified embodiment depicted in FIG. 9A, a supply hole 131*x* is provided at a first end in an extending direction of the supply common channel 131*e* and a return hole 132*x* is provided a second end in an extending direction of the return common channel 132*e*. In that configuration, the ink flow direction of the supply common channel 131*e* is opposite to that of the return common channel 132*e*.

The number of nozzles and pressure chambers included in each individual channel is not limited to those of the above embodiment. For example, in the first modified embodiment depicted in FIG. 9A, each individual channel 133 includes a nozzle 133*d* and two pressure chambers 133*c*. Each individual channel 133 may include two or more nozzles.

Each individual channel may not include the inlet communicating with the supply channel and the outlet communicating with the return channel.

Figure 9B:
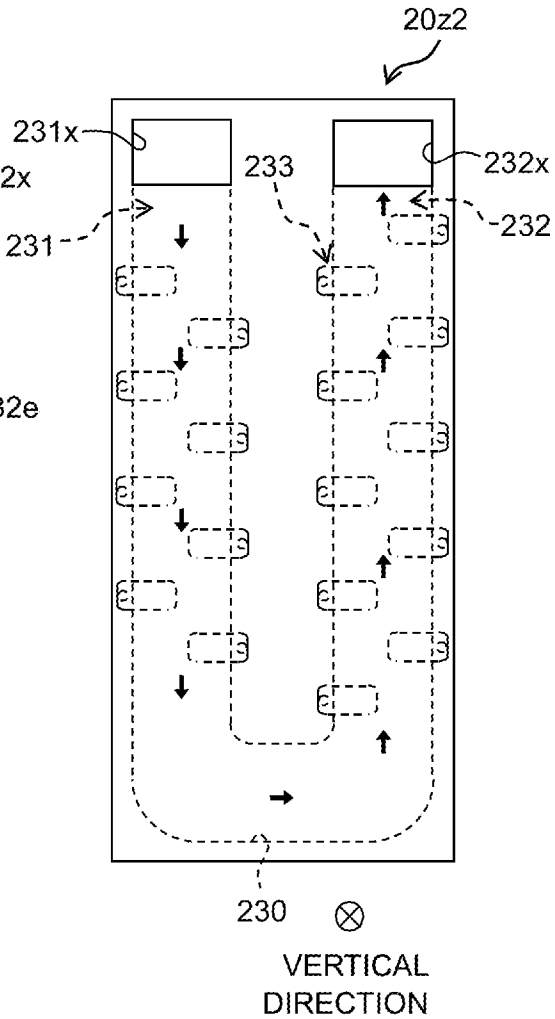
FIG. 9B is a plan view of a channel unit 20*z*2.
Figure 9A:
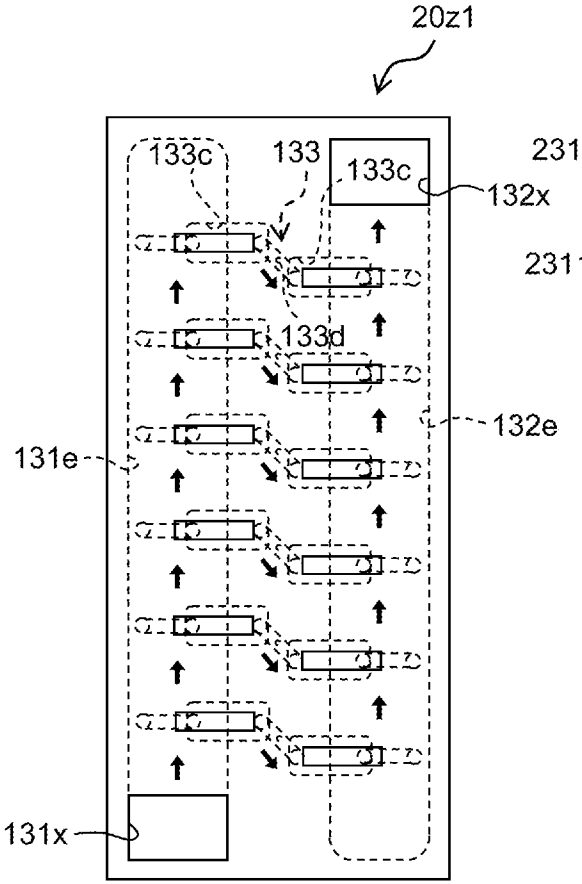
FIG. 9A is a plan view of a channel unit 20*z*1.

For example, a channel unit 20*z*2 according to a second modified embodiment depicted in FIG. 9B includes one common channel 230. The common channel 230 has a U shape when seen in the vertical direction. A supply hole 231*x* is provided at a first end of the common channel 230 and a return hole 232*x* is provided at a second end of the common channel 230. Part included in the first end of the common channel 230 and not overlapping in the vertical direction with multiple individual channel 233 corresponds to a supply channel 231. Part included in the second end of the common channel 230 and not overlapping in the vertical direction with the individual channels 233 corresponds to a return channel 232. In the second modified embodiment, although each individual channel 233 communicates with the supply channel 231 and the return channel 232 via the common channel 230, each individual channel 233 includes no inlet communicating with the supply channel 231 and no outlet communicating with the return channel 232.

For example, a channel unit 20*z*3 according to a third modified embodiment depicted in FIG. 9C includes a common channel 330. The common channel 330 has an I shape when seen in the vertical direction. A supply hole 331*x* is provided at a first end of the common channel 330 and a return hole 332*x* is provided at a second end of the common channel 330. Part included in the first end of the common channel 330 and not overlapping in the vertical direction with multiple individual channels 333 corresponds to a supply channel 331. Part included in the second end of the common channel 330 and not overlapping in the vertical direction with the individual channels 333 corresponds to a return channel 332. In this modified embodiment, although each individual channel 333 communicates with the supply channel 331 and the return channel 332 via the common channel 330, each individual channel 333 includes no inlet communicating with the supply channel 331 and no outlet communicating with the return channel 332.

In the above embodiment, each of the supply channel and the return channel includes the branch channel. Bubbles in the head can be efficiently discharged through the branch channel. The present disclosure, however, is not limited thereto. For example, the configuration of the above embodiment may not include the supply branch channel, the tubes 11*b*, the return branch channel, and the tubes 11*d*.

The return channel may be omitted. Namely, instead of the configuration in which ink circulates between a tank and the head, only a channel for supplying liquid such as the ink from the tank to the head may be provided.

The actuator is not limited to a piezo-type actuator using piezoelectric elements. The actuator may be, for example, a thermal-type actuator using heating elements or an electrostatic-type actuator using electrostatic force.

The driver and the heatsink may be provided, for example, on the walls 14*y* of the outside portion 14 of the above embodiment. In that configuration, the walls 14*y* may include the hollows 14*t*.

The head is not limited to the line-type head. The head may be a serial-type head in which liquid is discharged from nozzles on a medium (an object to which liquid is to be discharged) during movement of the head in a scanning direction parallel to a sheet with direction.

The medium is not limited to the sheet or paper, and may be a cloth, a substrate, and the like.

The liquid discharged from the nozzles is not limited to the ink, and may be any liquid (e.g., a treatment liquid that agglutinates or precipitates constituents of ink, liquefied metal, and liquefied resin).

The present disclosure is applicable to facsimiles, copy machines, multifunction peripherals, and the like without limited to printers. The present disclosure is also applicable to a liquid discharge apparatus used for any other application than the image recording (e.g., a liquid discharge apparatus that forms an electroconductive pattern by discharging an electroconductive liquid on a substrate).

What is claimed is:

1. A liquid discharge head, comprising:

a first channel unit in which a first channel is defined, the first channel unit including:

a first joining surface;

an opposite surface that is opposite to the first joining surface;

a tube disposed on the opposite surface and defining the first channel;

an outside portion disposed on the opposite surface and positioned outside the tube, the outside portion having an end at an upper end of the first channel unit in an orthogonal direction orthogonal to the first joining surface; and a coupling portion disposed on the opposite surface and coupling the outside portion and the tube, the coupling portion having an end at the upper end of the first channel unit in the orthogonal direction, and a second channel unit in which a second channel communicating with the first channel is defined, the second channel unit including a second joining surface joined to the first joining surface of the first channel unit, wherein the end of the outside portion and the end of the coupling portion extend to an identical position in the orthogonal direction, and the tube includes a circumferential portion that is exposed outside and extends in the orthogonal direction to the identical position to which the end of the outside portion and the end of the coupling portion extend.

2. The liquid discharge head according to claim 1, wherein the first joining surface has a first opening for the first channel and a first wall defining the first opening, the second joining surface has a second opening for the second channel that overlaps in the orthogonal direction with the first opening, and a second wall defining the second opening, the first opening and the second opening extend in a first direction parallel to the second joining surface, and, the second wall is longer in a second direction than the first wall, the second direction being orthogonal to the orthogonal direction and the first direction.

3. The liquid discharge head according to claim 2, wherein the first opening includes a plurality of first openings and the second opening includes a plurality of second openings, and a center-to-center distance in the second direction between the first openings is the same as a center-to-center distance in the second direction between the second openings.

4. The liquid discharge head according to claim 1, wherein the second joining surface has a second opening for the second channel and a second wall defining the second opening, and one of the outside portion and the coupling portion overlaps in the orthogonal direction with the second wall.

5. The liquid discharge head according to claim 4, wherein the second opening extends in a first direction parallel to the second joining surface, one of the outside portion and the coupling portion includes a first extending portion extending in the first direction, and the first extending portion does not overlap in the orthogonal direction with the second opening.

6. The liquid discharge head according to claim 1, wherein one of the outside portion and the coupling portion includes a second extending portion extending in a third direction parallel to the opposite surface, and a length in the orthogonal direction of the second extending portion is longer than a length in a fourth direction, which is orthogonal to the orthogonal direction and the third direction, of the second extending portion.

7. The liquid discharge head according to claim 1, wherein the first channel unit is made using a resin and is long in a fifth direction parallel to the first joining surface, and one of the outside portion and the coupling portion includes a third extending portion extending in the fifth direction.

8. The liquid discharge head according to claim 7, wherein the third extending portion includes a plurality of third extending portions, and the third extending portions have an identical length in a sixth direction that is parallel to the first joining surface and is orthogonal to the fifth direction.

9. The liquid discharge head according to claim 8, wherein the third extending portions define the first channel.

10. The liquid discharge head according to claim 7, wherein one of the outside portion and the coupling portion includes a fourth extending portion extending in a seventh direction that is parallel to the first joining surface and intersects with the fifth direction.

11. The liquid discharge head according to claim 7, wherein the first joining surface has a first opening for the first channel and a first wall defining the first opening, and the first wall includes a recess.

12. The liquid discharge head according to claim 11, wherein the first opening includes a plurality of first openings, and the recess is located between the first openings.

13. The liquid discharge head according to claim 11, wherein the recess is positioned away from the first opening by not less than 0.5 mm.

14. The liquid discharge head according to claim 1, wherein the first channel unit extends in a fifth direction parallel to the first joining surface, and the tube and the coupling portion are disposed at ends in the fifth direction of the first channel unit.

15. The liquid discharge head according to claim 14, wherein the tube and the coupling portion are disposed at a center portion in the fifth direction of the first channel unit.

16. The liquid discharge head according to claim 14, wherein the tube includes a plurality of tubes, and the tubes are arranged symmetrically with respect to a center point of the first channel unit in a plane orthogonal to the orthogonal direction.

17. The liquid discharge head according to claim 1, wherein the second channel includes a plurality of individual channels including a plurality of nozzles corresponding thereto, a supply channel, and a return channel, each of the individual channels has an inlet communicating with the supply channel and an outlet communicating with the return channel, and the first channel includes a channel communicating with the supply channel and a channel communicating with the return channel.

18. The liquid discharge head according to claim 1, further comprising:

an actuator;

a driver installed in the outside portion and configured to supply a driving signal to the actuator; and a heatsink thermally connected to the driver and installed in the outside portion to cover the driver.

19. The liquid discharge head according to claim 1, further comprising:

an actuator, and a trace member connected to the actuator and extending to an outside of the first channel unit, wherein a hollow configured to guide the trace member is located in an outside surface of the outside portion.

20. The liquid discharge head according to claim 1, wherein the outside portion includes a plurality of corners protruding toward the outside, and one of the corners is different in shape from the remaining other corners.

21. The liquid discharge head according to claim 1, wherein the first channel unit and the second channel unit extend in a fifth direction parallel to the first joining surface, and each of the first channel unit and the second channel unit has positioning holes at ends in the fifth direction, the positioning holes of the first channel unit overlapping in the orthogonal direction with the positioning holes of the second channel unit.

* * * * *